US005331757A

United States Patent [19]

Ernest et al.

[11] Patent Number: 5,331,757

[45] Date of Patent: Jul. 26, 1994

[54] SIGNHOLDER

[75] Inventors: Richard C. Ernest, Lake Forest, Ill.; P. Paul Retzinger, Cupertino, Calif.

[73] Assignee: Crown Metal Manufacturing Company, Elmhurst, Ill.

[21] Appl. No.: 956,627

[22] Filed: Oct. 5, 1992

[51] Int. Cl.[5] ..... G09F 15/00

[52] U.S. Cl. ..... 40/606; 40/661

[58] Field of Search ..... 40/661, 611, 606, 152.1, 40/155; 24/336

[56] References Cited

U.S. PATENT DOCUMENTS

| | | | |
|---|---|---|---|
| 2,050,136 | 8/1936 | Tucker et al. | 40/152.1 |
| 4,525,945 | 7/1985 | Shultz | 40/155 X |
| 4,726,132 | 2/1988 | Ernest | 40/661 |
| 4,790,093 | 12/1988 | Ernest et al. | 40/661 |
| 5,058,300 | 10/1991 | Ernest et al. | 40/661 X |

FOREIGN PATENT DOCUMENTS

| | | | |
|---|---|---|---|
| 2617304 | 11/1976 | Fed. Rep. of Germany | 24/336 |

*Primary Examiner*—Kenneth J. Dorner
*Assistant Examiner*—J. Silbermann
*Attorney, Agent, or Firm*—Silverman, Cass & Singer, Ltd.

[57] ABSTRACT

A signholder assembly including a retaining bracket and a pair of clear, relatively flexible planar panels. Each of the panels has a face surface and is substantially identical to one another and adapted to be mated to one another and mounted along a bottom edge in the retaining bracket by the assembly. A U-shaped insert is provided having an upstanding medial wall which forms a pair of channels for receiving the panels, the wall provided with protuberant structure along opposite surfaces thereof arranged to frictional engage against the panels to hold them in place in the channels. The protuberant structure enable varying panel thicknesses to be installed in the channels.

5 Claims, 1 Drawing Sheet

SIGNHOLDER

FIELD OF THE INVENTION

This invention relates generally to signholders and more particularly, to a plastic signholder and bracket having an insert for retaining two planar panels within the bracket and providing a bearing surface therebetween, said insert having protuberant means enabling the thickness of the panels to be varied.

BACKGROUND OF THE INVENTION

Signholders having a frame for supporting display cards, sheets or signs are known in the art. One type of signholder, for example, includes a metal bracket into which the sign can be inserted and which provides a metal support frame around the entire periphery of the sign. Such signholders typically are designed to be mounted onto a pedestal, hung from a bracket or mounted to a convenient surface.

It also is known to provide a plastic type signholder which can be mounted along one edge in a metal retaining bracket. These plastic signholders have been developed in one or two pieces with the plastic material providing the support for the sign, poster or card.

An example of such a signholder is disclosed in U.S. Pat. No. 4,726,132 which is assigned to the same assignee as the assignee herein. That signholder includes a two-piece molded plastic signholder and bracket which provides a top bearing surface between the two pieces to clamp the signs or cards therebetween. The two molded plastic pieces are reverse mirror images of one another and include positive engagement interlocking members along their bottom edges to align the two pieces. The retaining bracket is U-shaped including inwardly inclined bearing edges which bear against inclined bearing members provided along the bottom edge of the two pieces to ensure that the upper surfaces of the two pieces bear against one another to provide the desired clamping. Although such a signholder has been found to be useful, the molding of the two pieces to include the positive engagement and alignment members is somewhat intricate thereby providing increased molding costs.

In U.S. Pat. No. 5,058,300, owned by the same assignee as the assignee herein, there is disclosed a signholder having two planar pieces for engagement in a bracket wherein the planar pieces do not require the positive engagement members or the inclined bearing edges formed along their bottom edges and which still provided the desired bearing surface and alignment of the planar pieces.

An advantage achieved by the herein invention is to permit individual pairs of planar pieces or panels of different thickness to be accommodated in the signholder and bracket by means of a specially constructed insert for retaining the pair of panels within the bracket. Each panel of the pair is of the same thickness or gauge, yet a panel pair having a different thickness of individual panels can still be accommodated in the insert with equal efficacy. Further, the invention enables the individual panels to be cut from large plastic sheets which are not panels molded to a selected size and dimension. Thus, variant sizes of sign holders can be made without relying upon expensive molds to make a specific size sign holder.

SUMMARY OF THE INVENTION

A signholder and assembly including a retaining bracket and a pair of clear, relatively flexible planar panels. Each of the panels has a face surface and is substantially identical to one another and adapted to be mated to one another and mounted along a bottom edge in the retaining bracket by the assembly. The assembly further includes an insert capable of accepting the panels and is mountable within the retaining bracket. The retaining bracket is formed to bias the panels toward one another to form a bearing surface therebetween and create a gripping action between the face surfaces of the panels when they are mounted within the insert and the retaining bracket. The insert also includes a member for restraining the insert within the retaining bracket. The insert is provided with a series of protruding retainer formations on opposite surfaces of an upstanding wall part thereof for engaging the individual panels of a pair effectively over a range of different thickness of different panels of a panel pair.

DESCRIPTION OF THE PREFERRED EMBODIMENT

Figure 1:
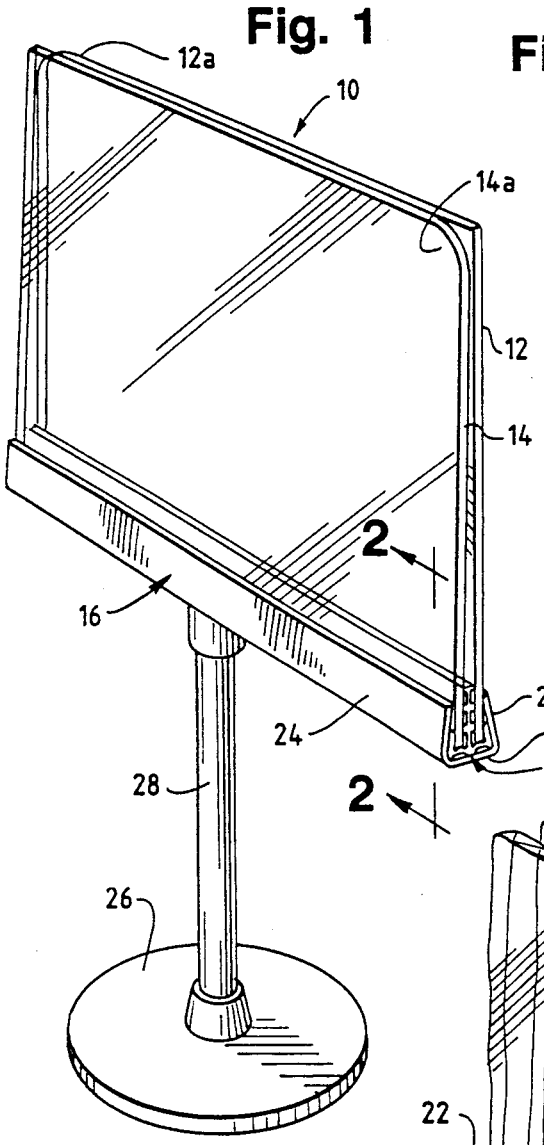
FIG. 1 is a perspective view of the signholder embodying the invention.
Figure 2:
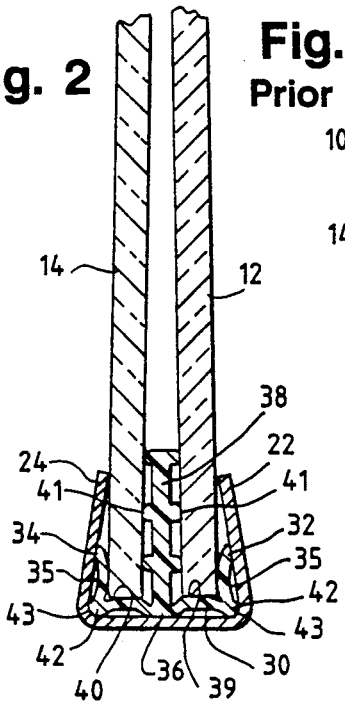
FIG. 2 is a cross-sectional view of the signholder taken along line 2–2 of FIG. 1 and in the direction indicated generally, illustrating the planar panels within the insert and the retaining bracket.
Figure 4:
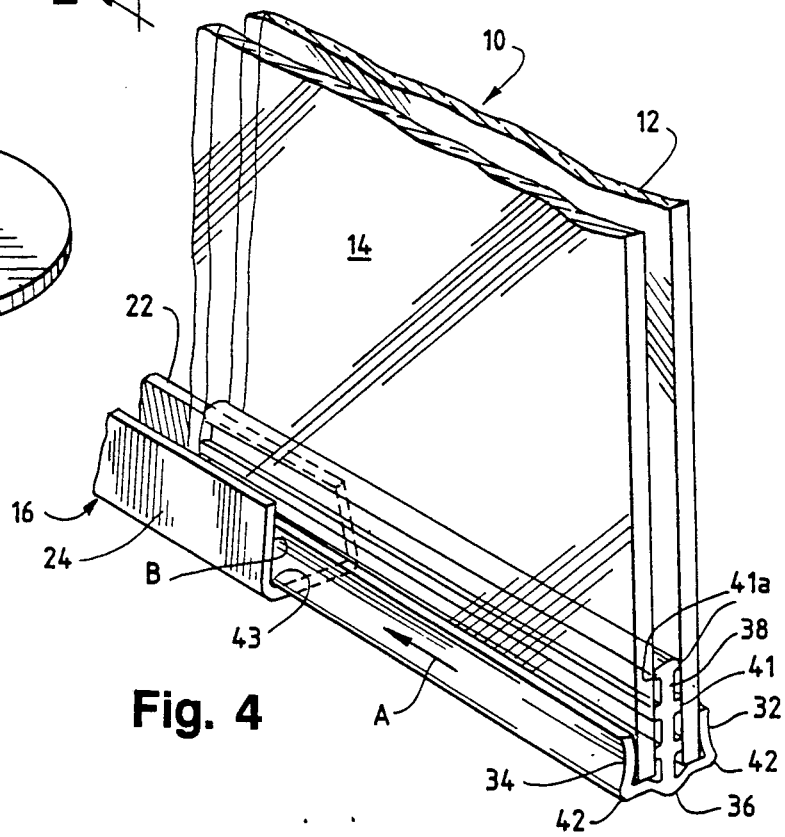
FIG. 4 is a partial perspective view of the signholder of FIG. 1 illustrating partial placement of the insert and the panels within the retaining bracket for completing the assembly.

Referring to FIGS. 1, 2 and 4, the signholder of the invention is designated generally by the reference numeral 10. The signholder 10 includes two planar panels 12 and 14, a retaining bracket 16 and an insert 18.

Generally, in operation, the signholder 10 is utilized to hold a card, sheet or sign (not illustrated) between the panels 12 and 14. Thus, in order to maintain such a card, sheet or sign between the panels 12 and 14, it is necessary to establish a bearing surface between the two panels 12 and 14 near their top edges to grip the card, sheet or sign therebetween. Such a bearing surface and gripping action are accomplished by the interaction between the two panels 12 and 14, the bracket 16 and the insert 18 as will be described in detail below.

The panels 12 and 14 preferably are substantially identical flat sheets and are formed of a clear, relatively flexible, plastic material which is economical, is substantially shatterproof and can be readily severed from plastic sheet material or molded to size, if preferred. In general, the plastic material can be selected from any of a number of clear synthetic plastic materials which are suitable for injection molding or available in plastic sheet stock. These properties, with the exception of low cost, can be provided by high quality polycarbonate-like materials. One specific suitable plastic material is a resin sold by the Eastman Kodak Company under the tradename KODAR, which also is a low cost material.

Another example of a suitable plastic material is an acrylic type resin.

Additionally, in order to provide increased gripping of the bearing surface provided between the two panels 12 and 14, the panels preferably are formed with a slight inward warp or curvature (not illustrated). Thus, when the panels are assembled in the insert 18 and the bracket 16, the desired increased gripping is achieved.

In order to assist in insertion of a desired sign between the panels 12 and 14, the panels can be formed with different heights (not illustrated). Alternatively, as FIG. 1 illustrates, one corner 12*a* or 14*a* of at least one panel 12 or 14 can be rounded off while the corner of the opposing panel remains square. In either case, a portion of a panel 12 or 14 extends away from the opposite panel so that a user can grasp the extended portion of the panel 12 or 14 to separate the panels for insertion of the sign. Furthermore, for insertion, the sign or card itself can abut the extended portion and be forced between the panels 12 and 14 by a user.

The bracket 16 preferably is formed from metal as a generally U-shaped or dovetail shaped channel member having a predetermined length which typically is based upon the desired size of the sign to be displayed. The bracket 16 is defined by a base 20 and upstanding leg members 22 and 24 integrally formed on either edge of the base 20 and extending in the same direction away from the base 20. Preferably, the leg members 22 and 24 are of approximately the same height and are inwardly inclined or tapered to provide a biasing force to retain the insert 18 and the planar pieces 12 and 14 within the bracket 16 as described hereinafter. Thus, the bracket 16 has a substantially dovetail shaped, cross-sectional configuration.

Typically, the bracket 16 is designed to display a sign or similar article supported on a surface such as a counter or the like (not illustrated). Accordingly, as FIG. 1 illustrates, the bracket 16 can be connected to a base 26 through a stem 28. Alternatively, the bracket 16 can include any type of base arrangement or the base can be eliminated altogether.

The insert 18 is provided for mounting both of the panels 12 and 14 within the bracket 16 with the desired bearing surface provided between the panels 12 and 14 as previously described. Thus, the insert 18 preferably is formed as a U-shaped channel member having a predetermined length, similar to the bracket 16. As illustrated in the drawings, the overall dimensions of the insert 18 are slightly smaller than the dimensions of the bracket 16 so that the insert 18 can fit within the confines of the bracket 16.

As FIGS. 2 and 4 illustrate, the U-shaped insert 18 formed by a base member 30 and first and second like, opposing wall members 32 and 34 integrally formed on either edge of the base member 30 and extending upwardly from base member 30. Preferably, the upstanding walls 32 and 34 are of approximately the same height and each has a medial curvature 35 extending in a direction outwardly or away from its opposite member. Said curved part 35 of each wall 32 and 34 is arranged to engage against an adjacent panel 12 or 14. The walls 32 and 34 are very short relative the walls 22 and 24 of the bracket. The base member or wall 30 has a medial protuberance In order to facilitate insertion of the insert 18 within the bracket 16, the insert 18 preferably is formed from a relatively resilient material, such as plastic. As with the panels 12 and 14, the plastic material selected for the insert 18 should have a low cost, be flexible and shatterproof as well as being readily moldable, but need not be transparent. Alternatively, any other type of material having substantially the same characteristics can be utilized so long as the desired mounting of the planar pieces 12 and 14 within the bracket 16 is achieved.

In order to mount the panels 12 and 14 within the insert 18, a longitudinally extending interior wall member 38 is provided within the U-shaped insert 18 upstanding from the base 30 proximately opposite the protuberance 36 and wall members 32 and 34. Thus, first and second longitudinal channels 39 and 40 of substantially equal width are formed within the U-shaped insert 18, the width of which may or may not be substantially corresponding to the thickness of the panels 12 and 14.

Integral with and extending from opposite surfaces of the wall member 38 is a series of spaced, rounded protuberances or hubs 41. The hubs 41*a* are formed contiguous with the upper end of the said wall 38. As seen in FIG. 2, two pairs of three such hubs have been illustrated as being substantially similar in configuration. It will be appreciated that the number of such hub pairs can be varied.

Figure 3:
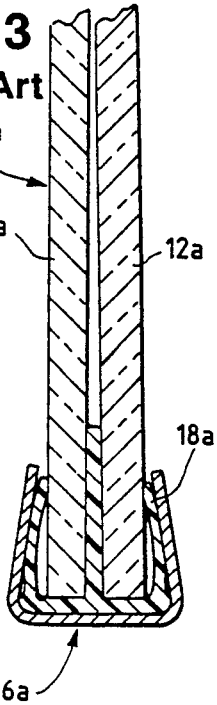
Fig. 3 Prior Art
FIG. 3 is a sectional view taken through the prior art signholder in the same orientation as FIG. 2, FIG. 3 being identical to FIG. 2 of said U.S. Pat. No. 5,058,300.

The protuberances 41 enable the panel members 12 and 14 to be of a thickness or gauge less than the panels 12*a* and 14*a* of the prior art structure of FIG. 3. Further, the height of the opposing walls 32 and 34 of insert 18 is less than that of the opposing walls 22 and 24 of the bracket 16. Major parts of the signholder 10*a* seen in FIG. 3 have been assigned corresponding identifying numerals but with the subscript character "a".

Due to the dovetail cross-section of the bracket 16, when the insert 18 is inserted within the bracket 16 the inwardly inclined leg members 22 and 24 of the bracket 16 force or bias the wall members 32 and 34 of the insert 18 slightly inward. This inward bias enables the planar pieces 12 and 14 to be restrained within the channels 39 and 40 when assembled.

Alternatively, the bracket 16 can be formed with the leg members 22 and 24 substantially perpendicular to the base 20 and the insert 18 can be formed with a substantially dovetail shaped cross-sectional configuration (not illustrated). Thus, the insert 18 provides the inward bias to restrain the planar pieces 12 and 14 within the channels 38 and 40.

In order to assist in mounting the planar pieces 12 and 14 within a desired channel 39 or 40, the interior wall member 38 has a height substantially greater than the height of the first and second wall members 32 and 34. Accordingly, the panels 12 or 14 readily can be mounted from the side of the insert 18 as well as from the end thereof.

Although the insert 18 normally can be retained within the bracket 16 by the inward taper of the legs 22 and 24 of the bracket 16, the first and second wall members 32 and 34 of the insert 18 can include an outwardly projecting rib 42 to further assist in retention of the insert 18 within the bracket 16. The ribs 42 are positioned on the exterior surfaces of the wall members 32 and 34 near the base 30 and extend along the length of the wall members 32 and 34.

As FIG. 2 illustrates, the ribs 42 engage against the corners 43 of the bracket 16. The medial protuberance 35 functions somewhat like a rail to facilitate entry of the insert 18 into the bracket 16.

To assemble the signholder 10, the panels 12 and 14 preferably are inserted within the channels 39 and 40 of the insert 18. Next, as FIG. 4 illustrates, the insert 18, with the two panels 12 and 14 therein, is slid into the bracket 16 from one end thereof in the direction indicated by arrow "A". Since the legs 22 and 24 of the bracket 16 are slightly inwardly inclined, they exert an inward force on the wall members 32 and 34 of the insert 18, and thus the two panels 12 and 14, in the direction indicated by arrows "B". At the same time, the ribs 42 slightly bow the base 30 of the insert 18. The walls 32 and 34 are curved into forced engagement with the walls of the bracket 16. After the insert 18 and planar pieces 12 and 14 are slid entirely into the bracket 16 to the final position illustrated in FIG. 1, a desired card or sign can be inserted between the panels 12 and 14.

The signholder 10 also can be assembled by first mounting the insert 18 within the bracket 16 without the panels 12 and 14. Then, the panels 12 and 14 can be inserted within the channels 39 and 40 to their desired positions.

It will be appreciated by comparison of the panels 12 and 14 shown in FIG. 1 and the panels **12*a* and 14*a* shown in FIG. 3, that the thickness of each panel 12 and 14 is less than that of each panel 12*a* and 14*a*. Yet, the brackets 16 and 16*a* are identical in size and configuration. The center wall 38 with the integral protuberances 41 enable a panel of different thickness to be used with equal efficacy since the protuberances 41 will take up the resulting space difference between the side walls of the bracket where thinner gauge panels 12 and 14 are used to hold the sign in place therebetween. As seen in FIG. 2, the protuberances 41 bear against the panels 12 and 14 and keep them wedged in place between the side walls 22 and 24 of the bracket 16**.

What is claimed and desired to be secured by Letters Patent of the United States is:

1. A signholder assembly including a U-shaped retaining bracket and a pair of clear, relatively resilient plastic planar pieces, each of said planar pieces having a face surface and an outside surface and a thickness which may vary slightly between the planar pieces, said planar pieces adapted to be mated to one another along upper portions of said face surface and mounted along a bottom portion in said retaining bracket by said assembly, said assembly further comprising: an insert formed of a relatively hard but resilient plastic material shaped as a channel member having a substantially U-shaped cross-sectional configuration formed by a base and first and second wall members upstanding from said base and a medial interior longitudinal wall member upstanding from said base between said first and second wall members thereby forming two longitudinal channels within said U-shaped channel member, each of said longitudinal channels capable of accepting a respective planar piece therein, each of said first and second wall members being curved in a convex shape facing away from a respective planar piece outer surface but in abutting relation therewith, said medial longitudinal wall having protuberant means extending from opposite sides thereof in contacting relationship with the facing sides of said planar panels, said base having a downwardly extending medial rib flanked by a bowed portion on each side thereof, and an outwardly extending rib at each end of the base at the junction with said first and second wall members whereby when said planar pieces and said channel member are mounted within said retaining bracket, said retaining bracket biases said first and second concave wall members against outer surfaces of said planar pieces to squeeze said planar pieces against said longitudinal wall portuberant means to form a bearing surface for said planar pieces, said biasing force being enhanced by the outwardly extending ribs causing the base to bow.

2. The assembly to claim 1 wherein said medial interior longitudinal wall member extends about said first and second wall members and wherein said protuberant means comprises laterally extending and vertically spaced nubs arranged in opposed pairs on opposite sides of said interior longitudinal wall member.

3. The assembly of claim 2 wherein said laterally extending spaced nubs have rounded ends, and one of said pairs of spaced nubs being located on a free end of said interior wall member.

4. The assembly of claim 1 wherein said medial interior longitudinal wall member extends upwardly from said base opposite said downwardly extending medial rib.

5. The assembly of claim 1 wherein said first and second concave wall members contact their respective planar pieces at an outside rounded medial portion only.

* * * * *

UNITED STATES PATENT AND TRADEMARK OFFICE

CERTIFICATE OF CORRECTION

PATENT NO. : 5,331,757

DATED : July 26, 1994

INVENTOR(S) : Richard C. Ernest, et al

It is certified that error appears in the above-indentified patent and that said Letters Patent is hereby corrected as shown below:

Column 3, line 64, after "protuberance" insert -- 36.--;

Column 4, line 19, change "hubs" (1st and 2nd occurrences) to --nubs--;

line 21, change "hubs" to --nubs--;

line 23, change "hub" to --nub--;

Column 6, line 28, change "to" to --of--.

Signed and Sealed this

Twenty-seventh Day of September, 1994

*Attest:*

Bruce Lehman

BRUCE LEHMAN

*Attesting Officer*

*Commissioner of Patents and Trademarks*